US011578383B2

(12) United States Patent
Hwang et al.

(10) Patent No.: US 11,578,383 B2
(45) Date of Patent: Feb. 14, 2023

(54) METHOD FOR MANUFACTURING HIGH-CARBON BEARING STEEL AND HIGH-CARBON BEARING STEEL MANUFACTURED THEREFROM

(71) Applicants: Hyundai Motor Company, Seoul (KR); Kia Corporation, Seoul (KR); Hyundai Steel Company, Incheon (KR)

(72) Inventors: Jae-Yoon Hwang, Seoul (KR); Min-Woo Kang, Gyeonggi-do (KR); Shin-Woong Jeong, Gyeonggi-do (KR); Soon-Jae Won, Daegu (KR); Sang-Min Song, Chungcheongnam-do (KR); Seung-Hyun Hong, Seoul (KR); Min-Woo Kang, Incheon (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/523,247

(22) Filed: Nov. 10, 2021

(65) Prior Publication Data

US 2022/0064755 A1 Mar. 3, 2022

Related U.S. Application Data

(62) Division of application No. 16/691,951, filed on Nov. 22, 2019, now Pat. No. 11,198,920.

(30) Foreign Application Priority Data

Jun. 3, 2019 (KR) ..... 10-2019-0065065

(51) Int. Cl.

| | |
|---|---|
| ***C21D 9/52*** | (2006.01) |
| ***C22C 38/44*** | (2006.01) |
| ***C22C 38/04*** | (2006.01) |
| ***C22C 38/02*** | (2006.01) |
| ***B21B 3/00*** | (2006.01) |
| ***C21D 1/32*** | (2006.01) |
| ***C21D 6/00*** | (2006.01) |
| ***C23C 8/32*** | (2006.01) |
| ***C23C 8/80*** | (2006.01) |
| ***C21D 8/06*** | (2006.01) |

(52) U.S. Cl.

CPC ..... *C21D 9/525* (2013.01); *B21B 3/00* (2013.01); *C21D 1/32* (2013.01); *C21D 6/004* (2013.01); *C21D 6/005* (2013.01); *C21D 6/008* (2013.01); *C21D 8/065* (2013.01); *C22C 38/02* (2013.01); *C22C 38/04* (2013.01); *C22C 38/44* (2013.01); *C23C 8/32* (2013.01); *C23C 8/80* (2013.01)

(58) Field of Classification Search

CPC ..... C21D 9/525; C21D 1/32; C21D 6/004; C23C 8/32; C23C 8/80

See application file for complete search history.

(56) References Cited

U.S. PATENT DOCUMENTS

2002/0066502 A1* 6/2002 Tako et al. ..... F16C 33/64 148/318

FOREIGN PATENT DOCUMENTS

| | | | |
|---|---|---|---|
| CN | 106256917 | A | 12/2016 |
| CN | 108220773 | A | 6/2018 |
| JP | 2013185167 | A | 9/2013 |
| JP | 6389031 | B2 | 9/2018 |

* cited by examiner

*Primary Examiner* — Jessee R Roe

(74) *Attorney, Agent, or Firm* — Fox Rothschild LLP

(57) ABSTRACT

Disclosed is a method for manufacturing high-carbon bearing steel, which include: heating a billet at a temperature of about 950 to 1,050° C. for about 70 to 120 minutes, rolling the billet to manufacture a wire rod, winding the wire rod to manufacture a wire rod coil, cooling the wire rod coil, and subsequently heat treating the wire rod coil for spheroidizing and carbonitriding, respectively. The bearing steel may include an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe) based on the total weight thereof.

3 Claims, 8 Drawing Sheets

(a)

(b)

METHOD FOR MANUFACTURING HIGH-CARBON BEARING STEEL AND HIGH-CARBON BEARING STEEL MANUFACTURED THEREFROM

CROSS-REFERENCE TO RELATED APPLICATIONS

This application is Divisional of U.S. application Ser. No. 16/691,951, filed Nov. 22, 2019, which claims priority under 35 U.S.C. § 119 to Korean Patent Application No. 10-2019-0065065, filed on Jun. 3, 2019, in the Korean Intellectual Property Office, the disclosure of which is incorporated herein by reference in its entirety.

TECHNICAL FIELD

The present invention relates to a method for manufacturing high-carbon bearing steel, high-carbon bearing steel manufactured therefrom, and a component (e.g., billet) manufactured from the high-carbon bearing steel.

BACKGROUND improving the fatigue life of high-carbon bearing steel, In the related art, studies for improving the fatigue life of high-carbon bearing steel have been conducted by controlling the production of non-metallic inclusions, for example, reducing the content of oxygen during the steelmaking process. However, the use environment of bearing steel is diversified and harsh, so that the improvement in fatigue life of bearing steel by controlling nonmetallic inclusions has reached the limit. In particular, high hardness and reinforcement of a matrix structure are required in order to improve the life of bearing steel used at a temperature of 100 to 300° C. and under a condition in which foreign materials are present, but for this purpose, alloying elements need to be additionally added. However, when an alloying element is added to high-carbon bearing steel, decarburization occurs in the heating step during the rolling process, and bainite and martensite structures, which are hardened structures, occur according to the cooling rate in the cooling step during the cooling process. Since the hardened structure reduces the processability of a material, breaks or cracks ultimately occur in the drawing step.

SUMMARY OF THE INVENTION

In preferred aspects, provided, inter alia, are a high-carbon bearing steel and method manufacturing the same. Particularly, the method may include steps of heating, rolling, and cooling steps in order to minimize the occurrence of decarburization and a hardened structure.

In an aspect, provided is a method for manufacturing high-carbon bearing steel. The method may include steps of: heating a billet at a temperature of about 950 to 1,050° C. for about 70 to 120 minutes, forming a wire rod using the billet. Optionally, the wire rod can be wound to manufacture a wire rod coil, cooling the wire rod coil, first heat treating the wire rod coil subjected to spheroidizing, and second heat treating the spheroidized wire rod coil subjected carbonitriding. The billet may include an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe), based on the total weight of the billet. Alternatively, the billet may consist essentially of, essentially consist of, or consist of: an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe), based on the total weight of the billet.

Preferably, the billet may further include one or more of: an amount of about 0.05 wt % or less of aluminum (Al), an amount of about 0.25 wt % or less of copper (Cu), an amount of about 0.03 wt % or less of phosphorus (P), an amount of about 0.01 wt % or less of sulfur (S), an amount of about 0.01 wt % or less of nitrogen (N), and an amount of about 0.0008 wt % or less of oxygen (O), based on the total weight of the billet.

Preferably, the rolling may include rolling performed at a temperature of about 870 to 950° C.

Preferably, the winding may be performed at temperature of about 850 to 900° C.

Preferably, the cooling step may include first cooling the wire rod coil to a temperature of about 650 to 700° C.

Preferably, a cooling rate of the first cooling may be about 2 to 3° C./s.

Preferably, the first cooling may be performed by a blast fan or a water spray.

Preferably, the cooling may include second cooling o the wire rod coil to a temperature of about 550 to 600° C.

Preferably, a cooling rate of the second cooling may be about 1° C./s or less.

Preferably, the second cooling may be performed by a slow cooling cover, hot wind, or a heater.

Preferably, the wire rod coil completely subjected to the second cooling may be stored at a temperature of about 550 to 600° C. in a reform tube.

Preferably, a carbon activity in austenite at 820° C. during the spheroidizing heat treatment step may be 0.72 to 0.76.

Preferably, the carbonitriding heat treatment may be performed at a temperature of about 830 to 870° C. for about 200 to 250 minutes.

Preferably, the method may further include tempering performed at a temperature of about 160 to 180° C. for 220 to 240 minutes.

Preferably, a size of a carbide after the second heat treating may be about 6.8 to 11.6 μm.

Preferably, a fraction of a carbide after the second heat treating may be about 12 to 16%.

Preferably, a surface hardness after the second heat treating may be about 800 to 873 HV.

Preferably, the method may further include manufacturing a billet from a bloom. The manufacturing the billet may include heating the bloom at a temperature of about 1,100 to 1,200° C., rolling the bloom at a temperature of about 1,100 to 1,200° C., and air-cooling the bloom.

In an aspect, provided is a bearing steel including an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe), all the wt % based on the total weight of the bearing steel. Particularly, the bearing steel may include a carbide having a size of about 6.8 to 11.6 μm.

Preferably, a fraction of the carbide may be about 12 to 16%.

Preferably, a surface hardness of the bearing steel may be about 800 to 873 HV.

The bearing steel may suitably include one or more of: an amount of about 0.05 wt % or less of aluminum (Al), an amount of about 0.25 wt % or less of copper (Cu), an amount of about 0.03 wt % or less of phosphorus (P), an amount of about 0.01 wt % or less of sulfur (S), an amount of about 0.01 wt % or less of nitrogen (N), and an amount of about 0.0008 wt % or less of oxygen (O), based on the total weight of the bearing steel.

The bearing steel may consist essentially of, essentially consist of, or consist of: an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe), all the wt % based on the total weight of the bearing steel.

According to exemplary embodiments of the present invention, the occurrence of decarburization and a hardened structure may be minimized by the method, e.g., heating the billet.

According to exemplary embodiments of the present invention, austenite crystal grains may be micronized by the method, e.g., rolling the billet.

According to exemplary embodiments of the present invention, the formation of a hardened structure may be suppressed and the impact toughness may be improved by the method, e.g., cooling the wire rod coil.

According to exemplary embodiments of the present invention, the quality of a spheroidal carbide may be secured without an increase in costs of the spheroidizing heat treatment by the method, e.g., by the first (spheroidizing) heat treating.

According to exemplary embodiments of the present invention, carbide may be micronized, the fraction of the micro carbide may be increased, and hardenability and softening resistance may be improved by the method, e.g., the second (carbonitriding) heat treating.

Thus, the bearing steel may have improved high temperature fatigue life and foreign material fatigue life by about 30% as compared to a material in the related art.

Other aspects of the invention are disclosed infra.

DETAILED DESCRIPTION

Hereinafter, the present invention will be described in detail. However, the present invention is not limited or restricted by exemplary embodiments, objects and effects of the present invention will be naturally understood or become apparent from the following description, and the objects and effects of the present invention are not limited by only the following description. Further, in the description of the present invention, when it is determined that the detailed description for the publicly-known technology related to the present invention can unnecessarily obscure the gist of the present invention, the detailed description thereof will be omitted.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 1:
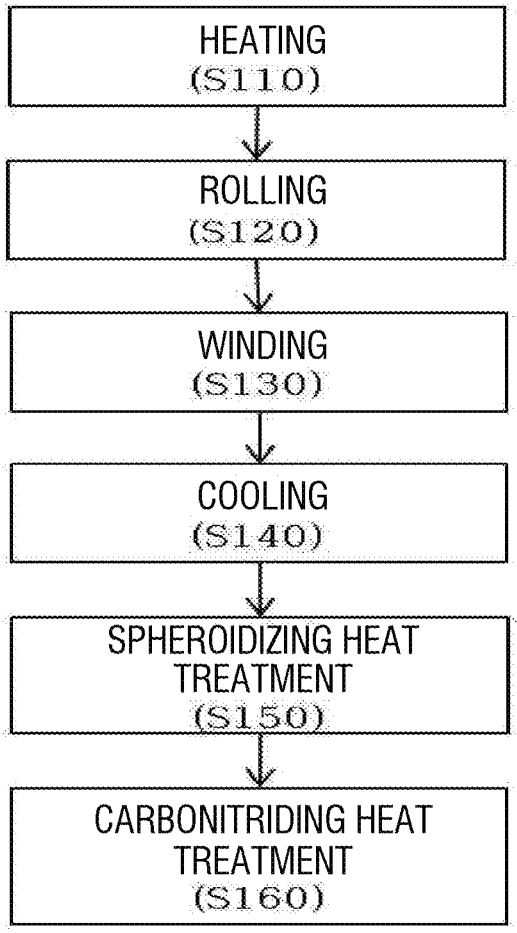
FIG. 1 is a flow chart of an exemplary method for manufacturing an exemplary high-carbon bearing steel according to an exemplary embodiment of the present invention.

FIG. 1 is a flow chart of an exemplary method for manufacturing an exemplary high-carbon bearing steel according to an exemplary embodiment of the present invention. As shown in FIG. 1, the manufacturing method may include a heating step of heating a billet (S110), a rolling step of manufacturing a wire rod by rolling the billet (S120), a winding step of manufacturing a wire rod coil by winding the wire rod (S130), a cooling step of cooling the wire rod coil (S140), a spheroidizing heat treatment (first heat treatment) step of subjecting the wire rod coil to spheroidizing heat treatment (S150), and a carbonitriding heat treatment (Second heat treatment) step of subjecting a drawn wire rod manufactured from the wire rod coil to carbonitriding heat treatment (S160).

Preferably, the heating step (S110) and the rolling step (S120) may be collectively referred to as a rolling process, and the winding step (S130), the cooling step (S140), and a reform tube storage step to be described below may be collectively referred to as a cooling process. Moreover, the high-carbon bearing steel mentioned in the present specification means a bearing steel including an amount of about about 1.00 wt % of carbon or an amount of about 0.9 to 1.3 wt % of carbon in the following Table 1, based on the total weight 100 wt % of the bearing steel.

Table 1 shows a main composition of a high-carbon bearing steel (hereinafter, the present bearing steel) manufactured from the present invention. Since the present bearing steel is manufactured from the billet in the heating step (S110), the composition of the present bearing steel means, that is, a composition of the aforementioned billet.

TABLE 1

| Classification | C | Si | Mn | Cr | Ni | Mo | Fe |
|---|---|---|---|---|---|---|---|
| Present bearing steel | 0.9 to 1.3 | 1.1 to 1.6 | 1.0 to 1.5 | 1.5 to 1.9 | 0.2 to 0.6 | 0.1 to 0.3 | Bal. |
| Bearing steel in the related art | 1.00 | 0.15 to 0.6 | 0.25 to 1.1 | 1.40 to 1.50 | Max. 0.30 | Max. 0.10 | Bal. |

(Unit: wt %)

As shown in Table 1, the present bearing steel may include an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe) based on the total weight of the bearing steel. The composition of the present bearing steel may be compared with the composition of the bearing steel in the related art as follows.

The bearing steel in the related art has a high temperature fatigue life (Lio) of about 15,000,000 times and a foreign material fatigue life (Lio) of about 10,000,000 times as described below, but as the environment in which the bearing steel is used becomes harsh, the improvement in high temperature and foreign material fatigue lives is required, and these fatigue lives may be improved by forming a micro carbide and improving the high temperature softening resistance.

Figure 2:
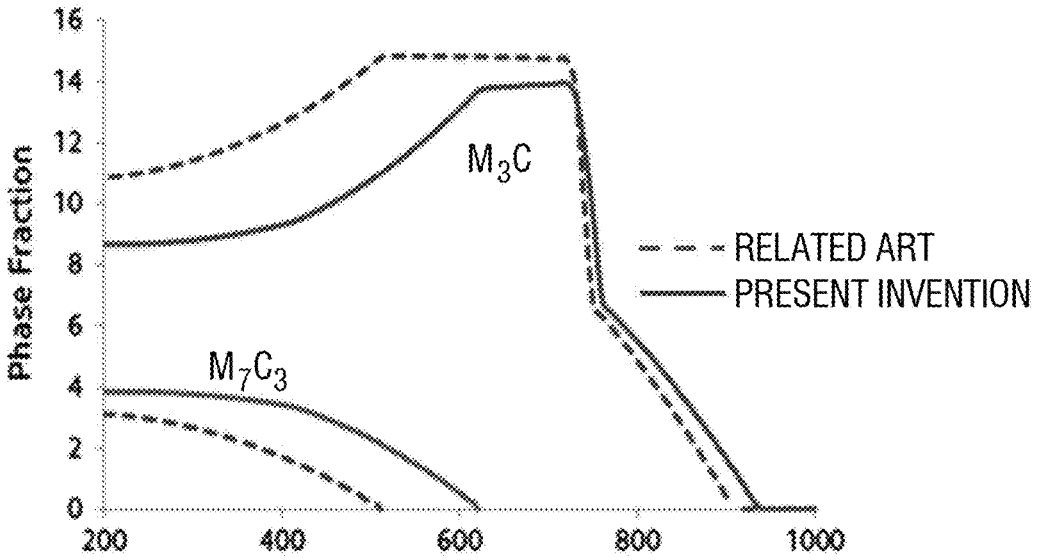
FIG. 2 is the phase fraction calculation result of an exemplary bearing steel according to an exemplary embodiment of the present invention and a bearing steel in the related art.

FIG. 2 is the phase fraction calculation result of the present bearing steel and a bearing steel in the related art. As shown in FIG. 2, it can be seen that both an $M_7C_3$-type carbide and $M_3C$-type carbide are present in two steel types. Particularly, an exemplary bearing steel of the present invention may include the $M_3C$-type carbide that may be changed more into more stable $M_7C_3$-type carbide at a temperature of about 200° C. Since the $M_7C_3$-type carbide is finer in size than the $M_3C$-type carbide, and thus may be advantageous in improving precipitation strengthening characteristics, it is possible to expect improvement in the fatigue life. Therefore, an amount of about 1.5 to 1.9 wt % of chromium based on the total weight of the bearing steel may be added to the bearing steel in order to increase the fraction of the $M_7C_3$-type carbide. Accordingly, there is an advantage in that spheroidizing heat treatment characteristics may also be secured.

The addition of nickel, molybdenum, silicon, and the like may be effective for the improvement in high temperature softening resistance. However, the addition of nickel and molybdenum may be accompanied by an excessive increase in manufacturing costs, and the addition of silicon may be advantageous in terms of manufacturing costs. When nickel and molybdenum are added in an amount of about 1.0 wt % or greater, decarburization may occur in the heating step during the rolling process, and in the drawn wire rod step, the spheroidizing heat treatment effect may be reduced, thereby causing an increase in heat treatment costs. In order to improve high temperature softening resistance, an amount of about 0.2 to 0.6 wt % of nickel, an amount of about 0.10 to 0.30 wt % of molybdenum, and an amount of about 1.1 to 1.6 wt % of silicon based on the total weight of the bearing steel may be added to an exemplary bearing steel, and the occurrence of decarburization may be minimized by controlling the heating conditions of the heating step during the rolling process. A detailed description on the composition of the present bearing steel is as follows. All the wt % are based on the total weight of the bearing steel or its composition.

(1) An Amount of about 0.9 to 1.3 wt % of Carbon

Carbon may increase strength and hardness by forming a carbide, and may stabilize austenite. When an amount less than about 0.9 wt % of carbon is added, the fatigue strength may be reduced, and when an amount greater than about 1.3 wt % of carbon is added, coarse carbides may be formed, and as a result, the fatigue strength and processability may be reduced. Accordingly, the bearing steel may include an amount of about 0.9 to 1.3 wt % of carbon based on the total weight of the bearing steel. Meanwhile, in order to achieve an effective object of the present invention, it is more preferred that the bearing steel may include an amount of about 0.95 to 1.05 wt % of carbon based on the total weight of the bearing steel.

(2) An Amount of about 1.1 to 1.6 wt % of Silicon

Silicon may be added as a deoxidizer, and may improve oxidation resistance, solid solution strengthening, and softening resistance. When an amount less than about 1.1 wt % of silicon is added, the softening resistance and strength may be reduced, and when an amount greater than about 1.6 wt % of silicon is added, decarburization may occur in the heating step during the rolling process, and the processability and spheroidizing heat treatment property may deteriorate. Accordingly, the bearing steel may include an amount of about 1.1 to 1.6 wt % of silicon based on the total weight of the bearing steel. Meanwhile, in order to achieve an effective object of the present invention, it is more preferred that the bearing steel may include an amount of about 1.1 to 1.3 wt % of silicon based on the total weight of the bearing steel.

(3) An Amount of about 1.0 to 1.5 wt % of Manganese

Manganese may increase the hardenability and strength. When an amount less than about 1.0 wt % of manganese is added, the hardenability and strength may be reduced, and when an amount greater than about 1.5 wt % of manganese is added, the processability may be reduced, segregation may occur, and the fatigue life may be reduced due to the precipitation of MnS inclusions. Accordingly, the bearing steel may include an amount of about 1.0 to 1.5 wt % of manganese based on the total weight of the bearing steel. Meanwhile, in order to achieve an effective object of the present invention, the bearing steel may include an amount of about 1.1 to 1.3 wt % of manganese based on the total weight of the bearing steel.

(4) An Amount of about 1.5 to 1.9 wt % of Chromium

Chromium may increase the hardenability, form a carbide, and micronize crystal grains. When an amount less than about 1.5 wt % of chromium is added, the hardenability and hardness may be reduced, and when an amount greater than about 1.9 wt % of chromium is added, the spheroidizing heat treatment property may be excessively improved, and manufacturing costs may be increased. Accordingly, the bearing steel may include an amount of about 1.5 to 1.9 wt % of chromium based on the total weight of the bearing steel. Meanwhile, in order to achieve an effective object of the present invention, it is more preferred that the bearing steel may include an amount of about 1.7 to 1.9 wt % of chromium, based on the total weight of the bearing steel.

(5) An Amount of about 0.2 to 0.6 wt % of Nickel

Nickel may improve the toughness and hardenability, micronize crystal grains, and strengthen the solid solution. When an amount less than about 0.2 wt % of nickel is added, the toughness and strength may be reduced, and when an amount greater than about 0.6 wt % of nickel is added, hot shortness may occur. Accordingly, the bearing steel may include an amount of about 0.2 to 0.6 wt % of nickel based on the total weight of the bearing steel. Meanwhile, in order to achieve an effective object of the present invention, it is more preferred that the bearing steel may include an amount of about 0.3 to 0.5 wt % of nickel based on the total weight of the bearing steel.

(6) An Amount of about 0.1 to 0.3 wt % of Molybdenum

Molybdenum may improve the hardenability and increase resistance to temper brittleness. When an amount less than about 0.1 wt % of molybdenum is added, the bearing steel may be susceptible to temper brittleness, and when an amount greater than about 0.3 wt % of molybdenum is added, the processability may be reduced. Accordingly, the bearing steel may include an amount of about 0.1 to 0.3 wt % of molybdenum based on the total weight of the bearing steel.

(7) An amount of about 0.5 wt % or less of Aluminum

Aluminum may be added as a deoxidizer, and may micronize crystal grains by forming AlN during the addition. When an amount greater than about 0.05 wt % of aluminum is added, oxide-based inclusions may be formed, and as a result, the fatigue life may be reduced. Accordingly, the bearing steel may include an amount of about 0.5 wt % or less of aluminum based on the total weight of the bearing steel. As a more preferred exemplary embodiment, the bearing steel may include an amount of about 0.009 wt % of aluminum based on the total weight of the bearing steel.

(8) An Amount of about 0.25 wt % or Less of Copper

Copper may increase the quenchability. However, when an amount greater than about 0.25 wt % of copper is included, cracks may occur during the hot working and the fatigue strength may be reduced. Accordingly, the bearing steel may be controlled to include an amount of about 0.25 wt % or less of copper based on the total weight of the bearing steel. As a preferred exemplary embodiment of the present invention, the bearing steel may include an amount of copper of about 0.070 wt % based on the total weight of the bearing steel.

(9) An Amount of about 0.03 wt % or Less of Phosphorus

Phosphorus may be as an inevitable impurity. However, when an amount greater than about 0.03 wt % of phosphorus is included, the occurrence of crystal grain boundary segregation, the reduction in toughness, the reduction in contact fatigue life, and the occurrence of cracks during the quenching may be caused. Accordingly, the bearing steel may be controlled to include phosphorus in an amount of about 0.03 wt % or less based on the total weight of the bearing steel. As a preferred exemplary embodiment of the present invention, the bearing steel composition may be controlled to include an amount of about 0.012 wt % of phosphorus based on the total weight of the bearing steel.

(10) An Amount of about 0.01 wt % or Less of Sulfur

Sulfur may increase the machinability, but may also be treated as an inevitable impurity. When an amount greater than about 0.01 wt % of sulfur is included, the fatigue life may be reduced due to the precipitation of MnS inclusions. Accordingly, the bearing steel may be controlled to include sulfur in an amount of about 0.01 wt % or less based on the total weight of the bearing steel. As a preferred exemplary embodiment of the present invention, the beating steel composition may be controlled to include 0.003 wt % of sulfur based on the total weight of the bearing steel.

(11) An Amount of about 0.01 wt % or Less of Nitrogen

Nitrogen may be an inevitable impurity. However, when an amount greater than about 0.01 wt % of nitrogen is included, the aging property caused by solid solution nitrogen may deteriorate. Accordingly, the bearing steel may be controlled to include nitrogen to an amount of about 0.01 wt % or less based on the total weight of the bearing steel. Accordingly, the bearing steel may be controlled to an amount of about 0.0055 wt % (55 ppm) of nitrogen based on the total weight of the bearing steel.

(12) An Amount of about 0.0008 wt % or Less of Oxygen

Oxygen may be an inevitable impurity. However, when an amount greater than about 0.0008 wt % of oxygen is included, the durability may be reduced due to the formation of oxide-based inclusions. Accordingly, the bearing steel may be controlled to include an amount of about 0.01 wt % or less of oxygen based on the total weight of the bearing steel. As a preferred exemplary embodiment of the present invention, the bearing steel composition may be controlled to include an amount of about 0.0004 wt % (4 ppm) of oxygen based on the total weight of the bearing steel.

Figure 3:
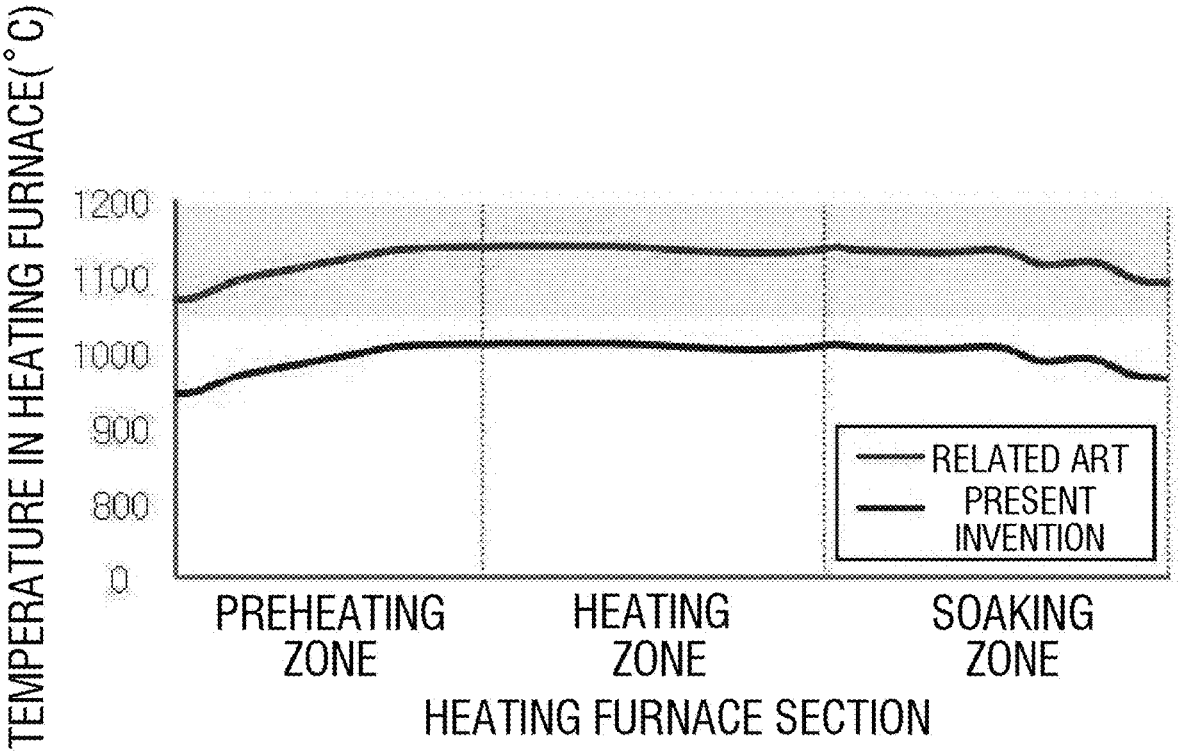
FIG. 3 is a graph illustrating the temperature at each exemplary heating furnace section of the heating step according to an exemplary embodiment of the present invention and the heating step in the related art.

FIG. 3 is a graph illustrating the temperature at each heating furnace section of the heating step of the present invention and the heating step in the related art. As shown in FIG. 3, the present invention may include heating a billet having the same composition as that of the present bearing steel in Table 1 at 950 to 1,050° C. for 70 to 120 minutes. When the present bearing steel is heated at a high temperature more than 1,050° C. for a long period of time as in the heating step in the related art (for example, 1,050 to 1,100°

C., 180 minutes), the concentration of carbon is decreased as decarburization occurs on the surface layer of the billet due to the increase in the composition of silicon (for example, a decarburization layer having a thickness of 150 um or more). Moreover, the hardenability of the surface layer is relatively increased, so that the hardened structure in the cooling step remarkably occurs, and breaks or cracks may occur in the drawing step.

Figure 4:
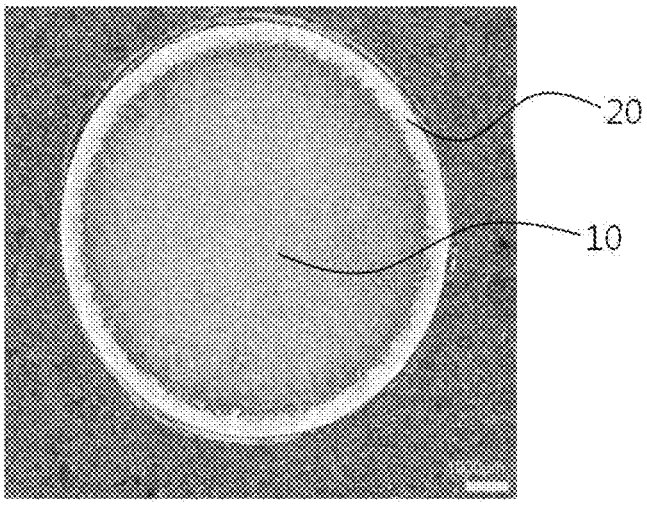
FIG. 4 is a photograph taken when a billet having a composition of a bearing steel as Comparative Example 1 is heated at a temperature of about 1,150° C. for about 120 minutes, and then rolled and cooled.
Figure 5:
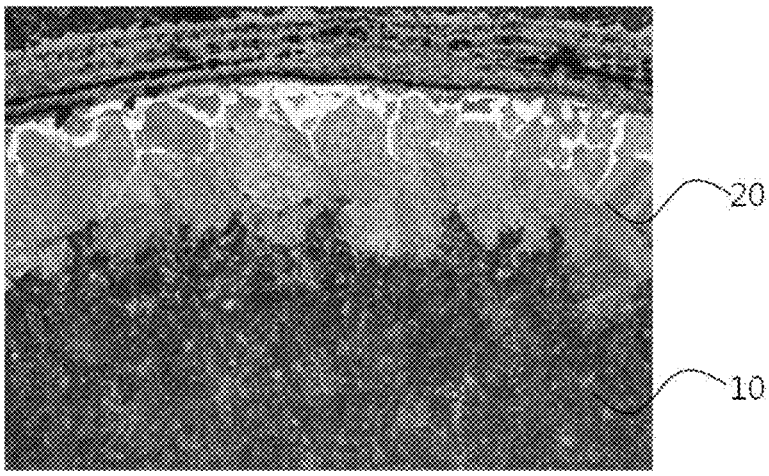
FIG. 5 is an enlarged photograph of the exemplary billet of FIG. 4.

FIG. 4 is a photograph taken when a billet having a composition of the present bearing steel as Comparative Example 1 is heated at 1,150° C. for 120 minutes, and then rolled and cooled. FIG. 5 is an enlarged photograph of FIG. 4. As shown in FIGS. 4 and 5, it can be seen that a perlite structure which is a normal structure may be formed in a central portion 10 of the billet, but bainite and martensite structures, which are hardened structures, may be formed to have a thickness of about 300 um on a surface layer 20.

Figure 6:
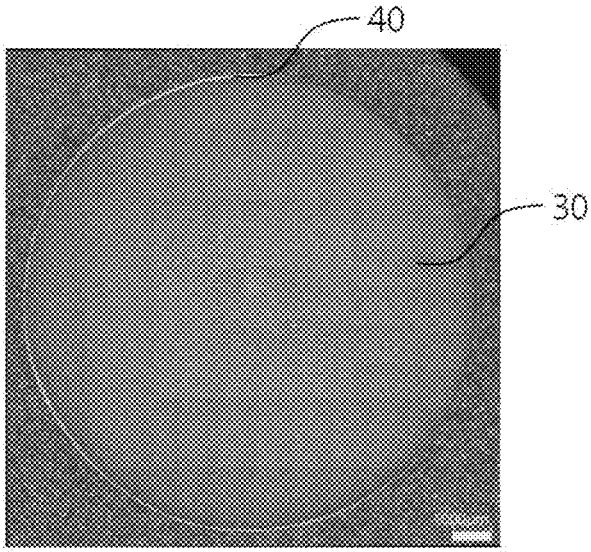
FIG. 6 is a photograph taken when an exemplary billet having an exemplary composition according an exemplary embodiment of the present bearing steel as Example 1 of the present invention is heated at a temperature less than about 1,050° C. for about 120 minutes, and then rolled and cooled.
Figure 7:
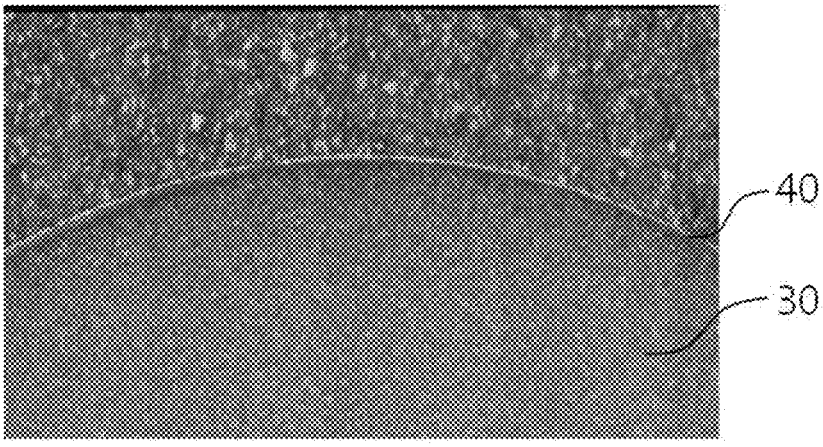
FIG. 7 is an enlarged photograph of the exemplary billet of FIG. 6.

FIG. 6 is a photograph taken when a billet having a composition of the present bearing steel as Example 1 of the present invention is heated at a temperature less than 1,050° C. for 120 minutes, and then rolled and cooled. FIG. 7 is an enlarged photograph of FIG. 6. As shown in FIGS. 6 and 7, a perlite structure which is a normal structure is formed in a central portion 30 of the billet, and bainite and martensite structures, which are hardened structures, may be formed on a surface layer 40, but Example 1 is compared with Comparative Example 1 because the thickness thereof is about 20 um. Accordingly, it can be seen that the occurrence of decarburization is minimized.

Figure 8:
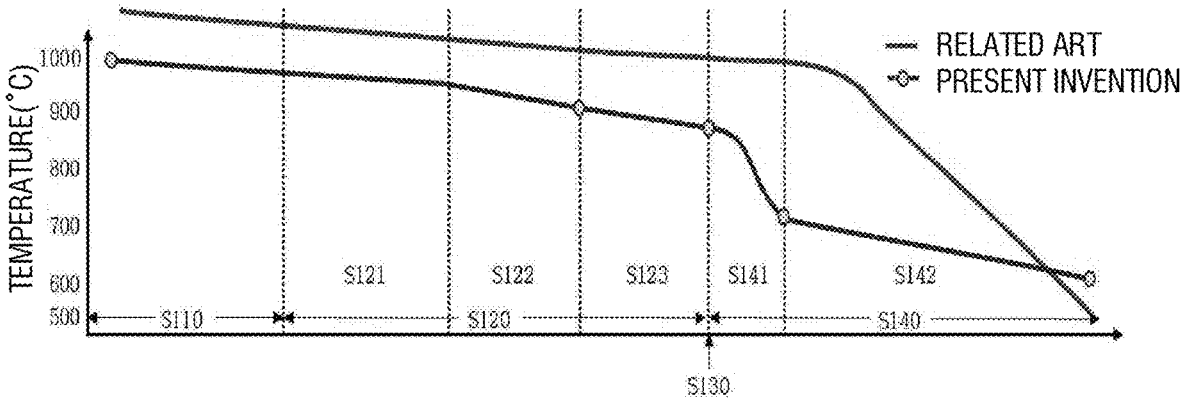
FIG. 8 illustrates a change in temperature from the rolling process to the cooling process according to an exemplary embodiment of the present invention.

FIG. 8 illustrates a change in temperature from the rolling process to the cooling process of the present invention. As shown in FIG. 8, the rolling step S120 of the present invention may include a rough and intermediate rolling step S121, a precision rolling step S122, and a finish rolling step S123. A separate cooling step differentiated from the cooling step S140 may be each present between the rough and intermediate rolling step S121 and the precision rolling step S122, and between the precision rolling step S122 and the finish rolling step S123.

The finish rolling step (S123) may be performed at a temperature of 870 to 950° C. When the finish rolling step (S123) is performed within the temperature range, austenite crystal grains may be micronized, the production of a hardened structure in the cooling step (S140) may be minimized, and the impact toughness may be improved. When the temperature of the performed finish rolling step is greater than 950° C., austenite crystal grains may be coarse. Accordingly, it is possible to delay the transformation rate of the material during the cooling step, to increase the probability that the hardened structure occurs on the surface layer of the material by increasing the hardenability, and to reduce the impact toughness.

As shown in FIG. 8, the winding step S130 may be preceded before performing the cooling step (S140), the winding step S130 may be performed by a laying head, and the temperature during the winding step may be about 850 to 900° C. It is preferred that the winding step (S130) is performed after cooling the wire rod to the aforementioned temperature range after the finish rolling step (S123). The cooling step (S140) may be performed during the conveyor transportation, and after performing the cooling step S140, the wire rod coil may be stored at a temperature of about 550 to 600° C. in a reform tube (reform tube storage step).

The cooling step S140 may include a first cooling step S141 of cooling the wire rod coil to a temperature of about 650 to 700° C., and the cooling rate of the first cooling step (S141) may be about 2 to 3° C./s. When the cooling rate is about 2 to 3° C./s, the phase transformation driving force may be secured, and the micronization of crystal grains may be promoted. However, when the cooling rate is less than about 2° C./s, a network-type proeutectoid cementite may be formed at a two-phase region (austenite and proeutectoid cementite) section between the temperature of the winding step and the Al (about 720° C.) temperature at which the phase transformation begins, and a two-phase structure in which a perlite structure which is a normal structure and bainite and martensite structures which are hardened structures are mixed may be formed. Accordingly, the brittleness of a material may be increased. When the cooling rate is greater than about 3° C./s, the wire rod coil may be locally supercooled because a cooling deviation occurs according to the position of the wire rod coil, so that a bainite or martensite structure may be formed. The first cooling step may be performed by a blast fan or a water spray, but is not limited thereto.

The cooling step (S140) may include a second cooling step (S142) of further cooling the wire rod coil to a temperature of about 550 to 600° C., and the cooling rate of the second cooling step (S142) may be about 1° C./s or less. As the cooling rate is delayed by lowering the cooling rate to 1° C./s or less, the formation of the hardened structure may be suppressed, and the impact toughness may be improved. The second cooling step may be performed by a slow cooling cover, hot wind, or a heater, but is not limited thereto.

Meanwhile, the present invention may further include a billet manufacturing step of manufacturing a billet from a bloom, and the billet manufacturing step may include a heating step of heating a bloom at a temperature of about 1,100 to 1,200° C., a rolling step of subjecting the bloom to finish rolling at a temperature of about 1,100 to 1,200° C., and a cooling step of air-cooling the bloom.

The present invention may include a spheroidizing heat treatment (S150) of subjecting the wire rod coil to spheroidizing heat treatment. The spheroidizing heat treatment S150 may be performed by heating and maintaining the wire rod coil at a temperature of about 820 to 850° C. for about 13 hours, and then cooling the wire rod coil to a temperature of about 700 to 730° C., and maintaining the wire rod coil for about 8 hours.

In order to secure spheroidizing heat treatment characteristics, the carbon activity in austenite needs to be managed at about 0.72 to 0.76 at a temperature of about 820° C. When the carbon activity is greater than about 0.76, the driving force for carbon diffusion may be decreased and it is difficult to secure spheroidizing characteristics as the difference in carbon concentration gradient from cementite to austenite is decreased during the spheroidizing heat treatment. When the composition of silicon is increased as in the composition of the present bearing steel, heat treatment conditions need to be changed in order to secure spheroidizing characteristics. Accordingly, there may be a problem in that heat treatment costs are increased, but when the composition of the present bearing steel is employed, it is possible to secure a spheroidizing ratio equivalent to that of a material in the related art without any increase in costs of a separate spheroidizing heat treatment.

TABLE 2

| Classification | C | Si | Mn | Cr | Ni | Mo | Carbon activity (820° C.) |
|---|---|---|---|---|---|---|---|
| Material in the related art | 1.00 | 0.60 | 1.10 | 1.52 | — | — | 0.76 |
| Comparative Example 2 | 1.10 | 1.50 | 0.60 | 1.50 | — | — | 0.96 |
| Example 2 | 1.00 | 1.20 | 1.20 | 1.80 | 0.40 | 0.20 | 0.72 |

(Unit of composition: wt %)

Figure 9:
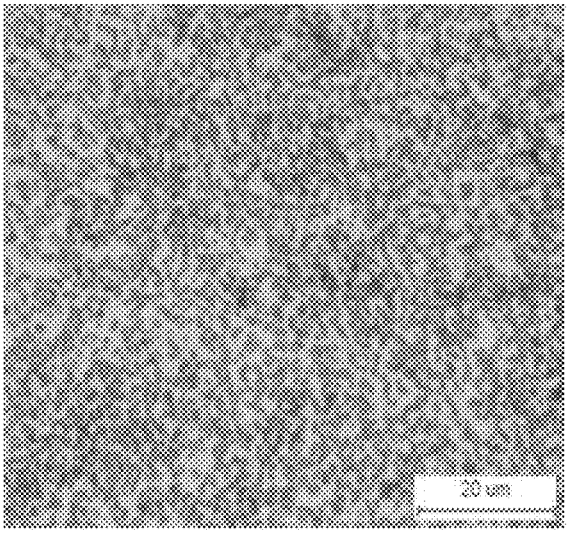
FIG. 9 is a photograph taken of a material in the related art, which is subjected to spheroidizing heat treatment.
Figure 10A:
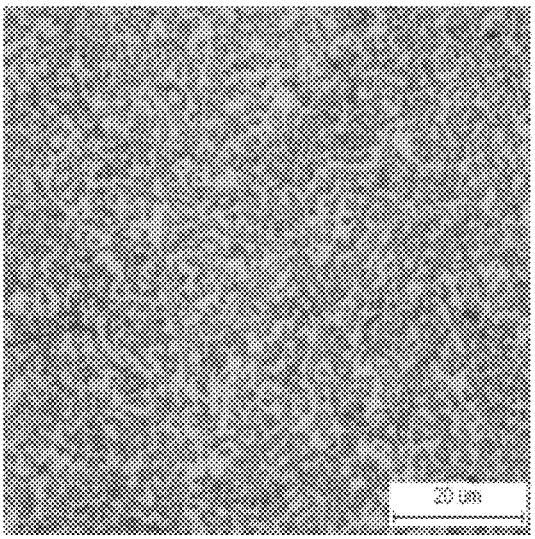
FIG. 10A is a photograph taken of Comparative Example 2, which is subjected to spheroidizing heat treatment.
Figure 10B:
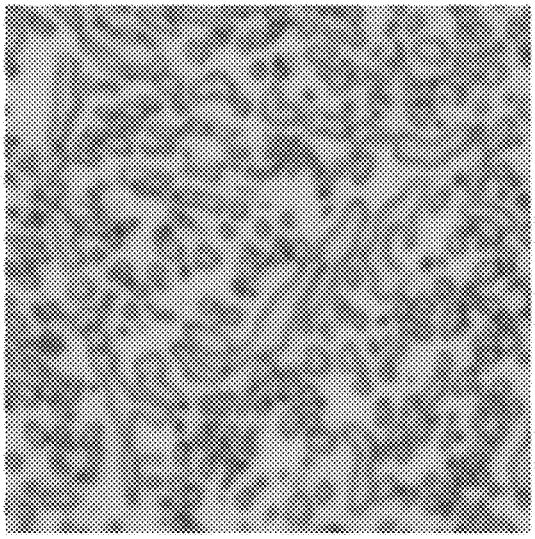
FIG. 10B is an enlarged photograph of FIG. 10A.
Figure 11:
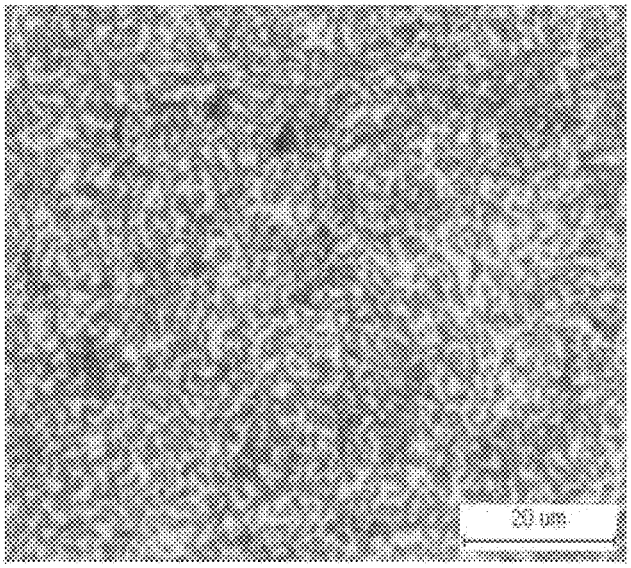
FIG. 11 is a photograph taken of Example 2, which is subjected to spheroidizing heat treatment according to an exemplary embodiment of the present invention.

Table 2 shows the main compositions and carbon activities at a temperature of about 820° C. in a material in the related art, Comparative Example 2, and Example 2. FIG. 9 is a photograph taken of a material in the related art, which is subjected to spheroidizing heat treatment. FIG. 10A is a photograph taken of Comparative Example 2, which is subjected to spheroidizing heat treatment, and FIG. 10B is an enlarged photograph of FIG. 10A. FIG. 11 is a photograph taken of Example 2, which is subjected to spheroidizing heat treatment. As shown in Table 2 and FIGS. 9 to 11, it can be seen that even though 1.50 wt % of silicon in Comparative Example 2 is included in a silicon composition range of 1.1 to 1.6 wt % of the present bearing steel, a coarse carbide is formed as the carbon activity may not be managed at about 0.72 to 0.76, and it can be seen that even though the composition of silicon in Example 2 is two times greater than the composition of silicon of the material in the related art, a spheroidizing ratio equivalent to that of the material in the related art is secured as the carbon activity may be managed at about 0.72 to 0.76.

The present invention may include a carbonitriding heat treatment (first heat treatment) step S160 of subjecting a drawn wire rod manufactured from the wire rod coil to carbonitriding heat treatment. The drawn wire rod may be manufactured through the drawing step, and it is preferred to perform the carbonitriding heat treatment (second hear treating) step (S160) after grinding the drawn wire rod. The conditions for the carbonitriding heat treatment may be the same as those in Table 3 below, the tempering temperature may be about 160 to 180° C., and the tempering may be about 220 to 240 minutes.

TABLE 3

| Temperature | Time | Carbon potential | $C_3H_8$ | $NH_3$ | RX gas |
|---|---|---|---|---|---|
| 830 to 870° C. | 200 to 250 minutes | 0.95 to 1.1% | 2 to 5 ℓ/min | 8 to 10 ℓ/min | 8 to 10 $m^3$/h |

TABLE 4

| Classification | Detailed classification | Material in the related art | Example 2 |
|---|---|---|---|
| Fraction of carbide (%) | Average | 8 | 15 |
| | Minimum | 5 | 12 |
| | Maximum | 10 | 16 |
| Maximum size of carbide (μm) | Average | 4 | 9 |
| | Minimum | 2.8 | 6.8 |
| | Maximum | 6.6 | 11.6 |

Figure 12:
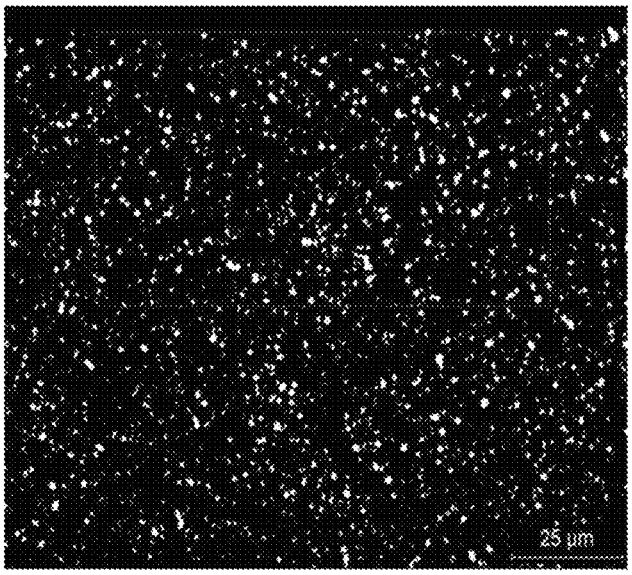
FIG. 12 illustrates a carbide distribution photograph of a material in the related art, which is subjected to carbonitriding heat treatment.
Figure 13:
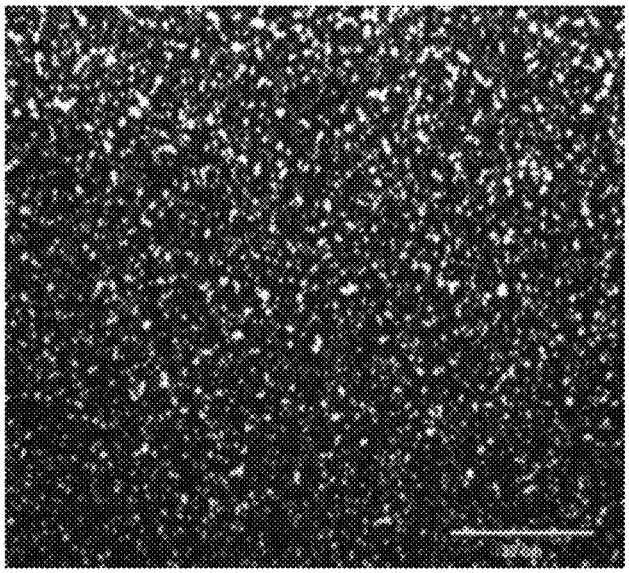
FIG. 13 illustrates a carbide distribution photograph of Example 2, which is subjected to carbonitriding heat treatment, according to an exemplary embodiment of the present invention.

Table 4 shows the fractions of carbide and maximum sizes of carbide of the material in the related art and Example 2, which are subjected to carbonitriding heat treatment. FIGS. 12 and 13 illustrate a carbide distribution photograph of the material in the related art and Example 2, which are subjected to carbonitriding heat treatment. Referring to Table 4 and FIGS. 12 and 13, it can be seen that in Example 2, both the fraction of the carbide and the maximum size of the carbide are increased.

TABLE 5

| Classification | Detailed classification | Material in the related art | Example 2 |
|---|---|---|---|
| Surface hardness (HV) | Average | 801 | 839 |
| | Minimum | 759 | 800 |
| | Maximum | 832 | 873 |
| Tempering softening resistance | | 0.97 | 0.98 |

Figure 14:
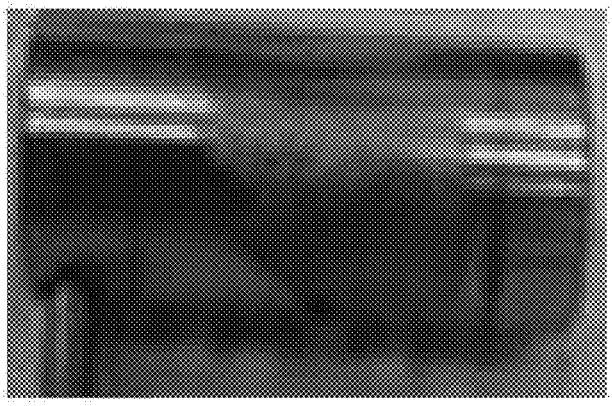
FIG. 14 is a photograph which confirms the surface damage after the durability of a material in the related art, which is subjected to carbonitriding heat treatment, is evaluated.
Figure 15:
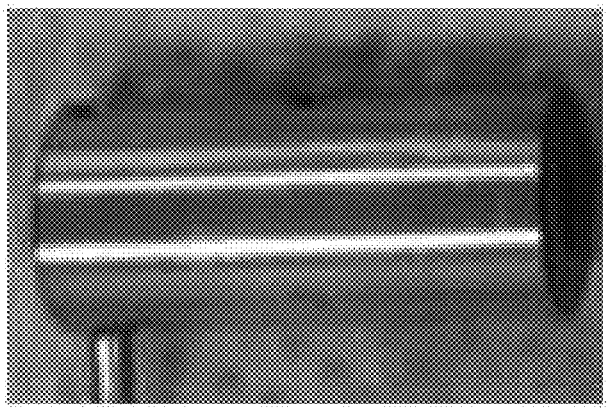
FIG. 15 is a photograph which confirms the surface damage after the durability of Example 2, which is subjected to carbonitriding heat treatment according to an exemplary embodiment of the present invention, is evaluated.

Table 5 shows the surface hardness and tempering softening resistance of each of the material in the related art and Example 2, which are subjected to carbonitriding heat treatment. FIGS. 14 and 15 are photographs which may confirm the surface damage after the durability of each of the material in the related art and Example 2 is evaluated. As shown in Table 5 and FIGS. 14 and 15, it can be seen that both the surface hardness and tempering softening resistance in Example 2 were increased, and flaking occurred to the material in the related, but did not occur to Example 2.

TABLE 6

| Classification | Material in the related art | Example 2 | Increase or decrease in life |
|---|---|---|---|
| $L_{10}$ | 15,179,000 | 20,770,000 | Improved by 37% |
| $L_{50}$ | 17,627,000 | 29,331,000 | Improved by 66% |

(Unit: cycle)

TABLE 7

| Classification | Material in the related art | Example 2 | Increase or decrease in life |
|---|---|---|---|
| $L_{10}$ | 9,893,900 | 12,580,000 | Improved by 27% |
| $L_{50}$ | 18,626,000 | 24,290,000 | Improved by 30% |

(Unit: cycle)

Tables 6 and 7 show high temperature rolling contact fatigue test and foreign material rolling contact fatigue test results for the material in the related art and Example 2. Here, high temperature means 200° C. As shown in Tables 6 and 7, based on the Lio fatigue life, Example 2 exhibits characteristics of the improvement in life by about 37% as compared to the material in the related art in the case of the high temperature fatigue test, and improvement of life by about 27% as compared to the material in the related art in the case of the foreign material fatigue test. Through the fatigue test results at a temperature of 200° C., it can be seen that at a temperature of about 100 to 300° C. which is a temperature region required to improve the fatigue life and at a temperature of about 150 to 250° C. which is a temperature region at which bearing steel is actually used, the fatigue life may be improved.

The present invention has been described in detail through representative Examples, but it is to be understood by a person with ordinary skill in the art to which the present invention pertains that various modifications are possible in the above-described Examples within the range not departing from the scope of the present invention. Therefore, the scope of the present invention should not be limited to the above-described Examples but should be determined by not only the claims to be described below but also all the changes or modified forms derived from the claims and the equivalent concept thereof.

What is claimed is:

1. A bearing steel comprising:

an amount of about 0.9 to 1.3 wt % of carbon (C), an amount of about 1.1 to 1.6 wt % of silicon (Si), an amount of about 1.0 to 1.5 wt % of manganese (Mn), an amount of about 1.5 to 1.9 wt % of chromium (Cr), an amount of about 0.2 to 0.6 wt % of nickel (Ni), an amount of about 0.1 to 0.3 wt % of molybdenum (Mo), and the balance iron (Fe), all the wt % based on the total weight of the bearing steel, wherein the bearing steel comprises a carbide having a size of about 6.8 to 11.6 μm, wherein a fraction of the carbide is about 12 to 16%.

2. The bearing steel of claim 1, wherein a surface hardness of the bearing steel is about 800 to 873 HV.

3. The bearing steel of claim 1, further comprising one or more: an amount of about 0.05 wt % or less of aluminum (Al), an amount of about 0.25 wt % or less of copper (Cu), an amount of about 0.03 wt % or less of phosphorus (P), an amount of about 0.01 wt % or less of sulfur (S), an amount of about 0.01 wt % or less of nitrogen (N), and an amount of about 0.0008 wt % or less of oxygen (O), based on the total weight of the bearing steel.

* * * * *